US007173503B1

(12) United States Patent
Cadotte, Jr.

(10) Patent No.: US 7,173,503 B1
(45) Date of Patent: Feb. 6, 2007

(54) MULTIBIT PHASE SHIFTER WITH ACTIVE AND PASSIVE PHASE BITS, AND ACTIVE PHASE BIT THEREFOR

(75) Inventor: Roland Cadotte, Jr., Freehold, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 172 days.

(21) Appl. No.: 10/901,525

(22) Filed: Jul. 29, 2004

(51) Int. Cl.
*H01P 9/00* (2006.01)
*H01P 1/18* (2006.01)

(52) U.S. Cl. ..... 333/164; 333/156

(58) Field of Classification Search ..... 333/164, 333/156, 138, 139
See application file for complete search history.

(56) References Cited

U.S. PATENT DOCUMENTS 3,319,079 A * 5/1967 Matsumoto ..... 327/233
3,590,285 A * 6/1971 Hargrove ..... 327/256
4,087,737 A * 5/1978 De Gennaro ..... 323/212
4,458,219 A * 7/1984 Vorhaus ..... 333/164
4,675,628 A 6/1987 Rosen ..... 333/164
4,754,265 A 6/1988 Henderson et al. ..... 340/653
4,994,773 A 2/1991 Chen et al. ..... 333/164
5,017,927 A 5/1991 Agrawal ..... 342/371
5,032,785 A * 7/1991 Mathis et al. ..... 324/107
5,093,667 A 3/1992 Andricos ..... 342/372
5,337,027 A * 8/1994 Namordi et al. ..... 333/161
6,525,627 B2 * 2/2003 Nakada ..... 333/161

* cited by examiner

*Primary Examiner*—Robert Pascal
*Assistant Examiner*—Kimberly E. Glenn
(74) *Attorney, Agent, or Firm*—Duane Morris, LLP

(57) ABSTRACT

An RF phase shifter includes the cascade of active and passive RF phase shift bits, having different phase increments. The active phase shift bit includes a FET with source and drain. First and second RF single-pole, double throw switches have their common elements coupled to the source and drain, respectively, for selectively connecting one of the in-phase source signals and out-of-phase drain signals to a third switch, and for coupling the non-selected signal to a reference. The third switch outputs the available signal. Additional phase increments may be included to achieve phase shifts or differences other than 180°.

13 Claims, 5 Drawing Sheets

MULTIBIT PHASE SHIFTER WITH ACTIVE AND PASSIVE PHASE BITS, AND ACTIVE PHASE BIT THEREFOR

FIELD OF THE INVENTION

This invention relates to digitally controlled RF phase shifters, and more particularly to phase shifter bits including active elements for performing phase shifting.

BACKGROUND OF THE INVENTION

Modern electromagnetic communications, surveillance and sensing increasingly rely on array antennas for interfacing or transducing between guided and unguided or freely propagating electromagnetic waves. The advantages of array antennas include the potential for large aperture with relatively light weight, instantaneous beam scanning, and multiple simultaneous beams, including "mbnopulse" operation.

The beam scanning attribute of array antennas requires that the phases of electromagnetic radiation applied to or from each elemental antenna of the array be controlled or adjusted, and these adjustments are performed by electromagnetic radio-frequency (RF) "phase shifters," where the definition of the term "RF" now includes all frequencies below light frequencies. The general background of the use of phase shifters and array antennas is described in U.S. Pat. No. 5,093,667, issued Mar. 3, 1992 in the name of Andricos. The use of phase shifters in conjunction with an array antenna for monopulse applications is described in U.S. Pat. No. 5,017,927, issued May 21, 1991 in the name of Agrawal et al.

The number of phase shifters in a phased-array antenna system may be as great as twice the number of antenna elements, in order to provide different phase shifts for transmitted and received signals. The cost of phase shifters may represent a major portion of the cost of an array antenna system. A common and relatively inexpensive type of phase shift bit is an ordinary transmission line, well known in the art, having a time delay equal to the desired phase shift at the frequency of operation. A plurality of such transmission lines can be intercoupled with electronic switches to form a multibit or digital phase shifter. In such an arrangement, several phase shifters are intercoupled, having different phase shifts, such as 180°, 90°, 45°, 22½°, and 11¼° for a 5-bit phase shifter. Such a combination of phase shifts can be combined to produce any desired phase shift ranging from 0° to 360°, with no more than about 60 of phase error. Naturally, more bits can be used if a smaller phase shift maximum error is desired. A disadvantage of such transmission-line phase shifters is that they tend to introduce transmission loss into the signal traversing the phase shifter. Another disadvantage of such transmission-line phase shifters is that the bandwidth of the phase shifter depends on its length. Details of a three-bit switched transmission line phase shifter are described in U.S. Pat. No. 4,754,265, issued Jun. 28, 1988 in the name of Henderson et al.

Other types of electromagnetic phase shifters are known. Phase shifters directly controlled by light are described in U.S. Pat. No. 4,675,628, issued Jun. 23, 1987 in the name of Rosen. Electromagnetic phase shifters in which the signal is phase shifted, amplitude controlled, and combined to produce the phase shifted signal are described in U.S. Pat. No. 4,994,773, issued Feb. 19, 1992 in the name of Chen et al.

Improved or alternative phase shifter configurations are desired.

SUMMARY OF THE INVENTION

A controllable RF phase shifter according to an aspect of the invention comprises a controllable active RF phase bit including an RF path having a first phase increment (0° or 180°). The phase shifter (also includes a controllable passive RF phase bit) including an RF path having a second phase increment (0°, 90°) different from the first phase increment (0°, 180°). RF coupling means are coupled to the active and passive RF phase bits, for coupling the RF paths of the active and passive phase bits in cascade. Control means are coupled to the active and passive phase bits for controlling each of the active and passive RF phase bits to one of first and second states, for thereby imposing upon RF signal traversing the cascade the first phase increment (180°), the second phase (90°) increment, the sum of the first and second phase increments (270°), or no phase increment (0°).

A phase shifter according to an aspect of the invention comprises a solid-state device including a path for the flow of electrical current between first and second electrodes and a control electrode for controlling the flow of current through the path. A source of signal to be phase shifted is coupled to the control electrode of the device, for controlling the flow of current through the path in response to the signal in such a manner that first electrode signal appearing at the first electrode in response to the signal coupled to the control electrode is in a first phase state (180°) relative to the signal at the control electrode, and in such a manner that second electrode signal appearing at the second electrode in response to the signal coupled to the control electrode is in a second phase state (0°), different from the first phase state (180°). A first switch includes a common terminal coupled to the first electrode of the device and a first independent terminal coupled to reference potential, and also includes a second independent terminal, for, in a first state (180°) of the first switch, coupling the first electrode of the device to the second independent terminal of the first switch, and for, in a second state (0°), coupling the first electrode of the device to the reference potential. A second switch includes a common terminal coupled to the second electrode of the device and a first independent terminal, and also includes a second independent terminal coupled to reference potential, for, in a first state (180°) of the second switch, coupling the second electrode of the device to the second independent terminal of the second switch, and for, in a second state (0°) of the second switch, coupling the second electrode of the device to the first independent terminal of the second switch. A third switch includes a common terminal, and first and second independent terminals. The first independent terminal of the third switch is coupled to the first independent terminal of the second switch and the second independent terminal of the third switch is coupled to the second independent terminal of the first switch. The third switch connects the common terminal of the third switch to the second independent terminal of the third switch in a first state (180°) of the third switch, and connects the common terminal of the third switch to the first independent terminal of the third switch in the second state (0°) of the third switch. Control means are coupled to the first, second, and third switches, for, in a first nominal phase condition (180°), simultaneously controlling the first, second, and third switches to the first states (180°) of the first, second, and third switches, and for, in a second nominal phase condition (0°), simultaneously controlling the first, second, and third switches to the second states (0°) of the first, second, and third switches.

In a particularly advantageous embodiment of this aspect of the invention, the first phase state is 180° and the second phase state is 0°.

A phase shifter according to an aspect of the invention comprises a solid-state device including a path (source to drain) for the flow of electrical current between first and second electrodes, and also includes a control electrode for controlling the flow of current through the path (source to drain). The phase shifter also includes a source of signal to be phase shifted. The source of signal is coupled to the control electrode of the device, for controlling the flow of current through the path (source to drain) in response to the signal in such a manner that first electrode signal appearing at the first electrode in response to the signal coupled to the control electrode is nominally out-of-phase relative thereto, and in such a manner that second electrode signal appearing at the second electrode in response to the signal coupled to the control electrode is nominally in-phase relative thereto. The phase shifter also includes a first switch including a common terminal coupled to the first electrode of the device and a first independent terminal coupled to reference potential (ground). The first switch also includes a second independent terminal. The first switch, in a first state (180°) of the first switch, couples the first electrode of the device to the second independent terminal of the first switch, and in a second state (0°), couples the first electrode of the device to the reference potential (ground). A second switch includes a common terminal coupled to the second electrode of the device and also includes a first independent terminal, and also includes a second independent terminal coupled to reference potential (ground). The second switch, in a first state (180°) of the second switch, couples the second electrode of the device to the second independent terminal of the second switch, and in a second state (0°) of the second switch, couples the second electrode of the device to the first independent terminal of the second switch. A third switch includes a common terminal, and first and second independent terminals. The first independent terminal of the third switch is coupled to the first independent terminal of the second switch, and the second independent terminal of the third switch is coupled to the second independent terminal of the first switch. The third switch connects the common terminal of the third switch to the second independent terminal of the third switch in a first state (180°) of the third switch, and connects the common terminal of the third switch to the first independent terminal of the third switch in the second state (0°) of the third switch. Control means are coupled to the first, second, and third switches, for, in a 180° condition, simultaneously controlling the first, second, and third switches to the first states of the first, second, and third switches, and for, in a 0° condition, simultaneously controlling the first, second, and third switches to the second states (0°) of the first, second, and third switches.

An active electromagnetic RF phase bit according to another aspect of the invention comprises a FET including source, drain, and gate electrodes, and direct-current biasing means coupled to the source, drain, and gate electrodes, for providing biasing energization to the FET. Source, drain, and gate direct-current blocking means are coupled to the source, drain, and gate, respectively, of the FET, for providing RF ports into the bias energized source, drain, and gate electrodes of the FET. An RF signal input path is coupled to the gate direct-current blocking means, whereby electromagnetic RF applied to the RF input port is coupled to the gate electrode of the FET. The RF phase bit also includes first, second, and third three-port, single-pole, double-throw RF switches, each including a common or "movable" port and also including first and second individual ports to which the common port is connected in first (0°) and second (180°) states, respectively, of the RF switches. The common port of the first RF switch is coupled or connected to the drain direct-current blocking means, and the first individual port of the first RF switch is coupled or connected to an RF reference potential such as ground. The common port of the second RF switch is coupled to the source direct-current blocking means, and the second individual port of the second RF switch is coupled or connected to RF reference potential. The RF phase bit includes first coupling means coupling the second individual port of the third RF switch to the second individual port of the first RF switch, and second coupling means coupling the first individual port of the third RF switch to the first individual port of the second RF switch. An RF output signal path is coupled to the common port of the third RF switch. Control means are provided, coupled to the first, second, and third RF switches, for causing the third RF switch to assume the first state in response to a request for a reference phase condition (0°) and the second state (180°) in response to a request for a 180° reference phase condition, and for causing the first and second RF switches to assume the first state in response to a request for a reference phase condition and the second state in response to a request for a 180° phase condition.

In a particular embodiment of this aspect of the invention, each of the first and second coupling means comprises an RF attenuator, which may be controllable. Each of the source and drain direct-current blocking means may comprise a capacitor. In one embodiment, each of the direct-current biasing means coupled to the source, drain, and gate electrodes, respectively, comprises at least an impedance element, exhibiting an impedance of at least 250 ohms at operational frequencies of the phase bit, coupled to the source, drain, and gate electrodes, respectively, and to at least one bias voltage source. A preferred version of this aspect of the invention includes, in each of the direct-current biasing means coupled to the source, drain, and gate electrodes, respectively, a capacitor coupled the impedance element and to the reference potential.

According to another aspect of the invention, a multibit RF phase shifter comprises a phase shifter path for the flow of RF signal between first and second phase shifter ports. The multibit RF phase shifter includes a passive first phase bit having a phase increment of less than 180° relative to a reference value. The first phase bit comprises first and second differing lengths of transmission line, and first bit switching means coupled to the first and second lengths of transmission line for, in a first state (0°) of the first phase bit, connecting the first length of transmission line in the first path, and for, in a second state (180°) of the first phase bit, connecting the second length of transmission line in the phase shifter path. The multibit RF phase shifter also includes an active second RF phase bit. The active second RF phase bit comprises a FET including source, drain, and gate electrodes, and direct-current biasing means coupled to the source, drain, and gate electrodes, for providing biasing energization to the FET. The multibit RF phase shifter also includes source, drain, and gate direct-current blocking means coupled to the source, drain, and gate, respectively, of the FET, for providing RF paths, but not direct-current paths, to the bias energized source, drain, and gate electrodes of the FET. A second RF signal path is coupled to the gate direct-current blocking means, whereby electromagnetic RF applied to a second phase bit RF input port is coupled to the gate electrode of the FET. First, second, and third three-port, single-pole, double-throw RF switches each include a common port, and first and second individual ports to which the common port is connected in first (0°) and second (180°) states, respectively, of the RF switches. The common port of the first RF switch is coupled to the drain direct-current blocking means, and the first individual port of the first RF switch is connected to RF reference potential. The common port of the second RF switch is coupled to the source direct-current blocking means, and the second individual port of the second RF switch is connected to RF reference potential. A first coupling means couples the second individual port of the third RF switch to the second port of the first RF switch, and second coupling means couples the first individual port of the third RF switch to the first individual port of the second RF switch. Second RF phase bit control means are coupled to the first, second, and third RF switches for causing the third RF switch to assume the first state (0°) in response to a request for a nominal 0° phase condition and the second state (180°) in response to a request for a nominal 180° phase condition, and for causing the first and second RF switches to assume the first state (0°) in response to a request for a reference phase condition and the second state (180°) in response to a request for a 180° phase condition. Second RF phase bit connection means are coupled to the phase shifter path, to the RF input port and to the common port of the third RF switch, for cascading the first phase bit with the second phase bit.

In a particularly advantageous version of this aspect of the invention, the first phase bit includes no active element other than switching element(s).

A phase shifter according to another aspect of the invention comprises a solid-state device including a path for the flow of electrical current between first and second electrodes and a control electrode for controlling the flow of current through the path. The phase shifter also includes a source of signal to be phase shifted, the source of signal being coupled to the control electrode of the device, for controlling the flow of current through the path in response to the signal in such a manner that first electrode signal appearing at the first electrode in response to the signal coupled to the control electrode is in a first phase state relative thereto, and in such a manner that second electrode signal appearing at the second electrode in response to the signal coupled to the control electrode is in a second phase state, different from the first phase state. A first switch includes a common terminal coupled to the first electrode of the device and a first independent terminal coupled to reference potential, and also includes a second independent terminal, for, in a first state of the first switch, coupling the first electrode of the device to the second independent terminal of the first switch to thereby define a first signal path for the flow of signal from the first electrode of the device to the second independent terminal of the first switch, and for, in a second state, coupling the first electrode of the device to the reference potential. A second switch includes a common terminal coupled to the second electrode of the device and a first independent terminal, and also includes a second independent terminal coupled to reference potential, for, in a first state of the second switch, coupling the second electrode of the device to the second independent terminal of the second switch, and for, in a second state of the second switch, coupling the second electrode of the device to the first independent terminal of the second switch, thereby defining a second signal path for the flow of signal from the second electrode of the device to the second independent terminal of the second switch. A third switch includes a common terminal, and first and second independent terminals. The first independent terminal of the third switch is coupled by a fourth signal path to the first independent terminal of the second switch, and the second independent terminal of the third switch is coupled by a third signal path to the second independent terminal of the first switch. The third switch connects the common terminal of the third switch to the second independent terminal of the third switch in a first state of the third switch, and connects the common terminal of the third switch to the first independent terminal of the third switch in the second state of the third switch. Control means are coupled to the first, second, and third switches, for, in a first nominal phase condition, simultaneously controlling the first, second, and third switches to the first states of the first, second, and third switches, and for, in a second nominal phase condition, simultaneously controlling the first, second, and third switches to the second states of the first, second, and third switches. A passive phase introducing element is coupled in at least one of the first, second, third, and fourth signal paths, for modifying the phase difference or phase shift occurring upon simultaneous control by the control means between the first and second nominal phase conditions to be other than. In a particularly advantageous embodiment of this embodiment of the invention, the first phase state of the first electrode signal appearing at the first electrode in response to the signal coupled to the control electrode is nominally 180°, and the second phase state (O) of the second electrode signal appearing at the second electrode in response to the signal coupled to the control electrode is nominally 0°. Such a phase shifter may further include or be associated with a controllable passive RF phase bit including an RF path having a second phase increment different from the phase difference.

DESCRIPTION OF THE INVENTION

Figure 1:
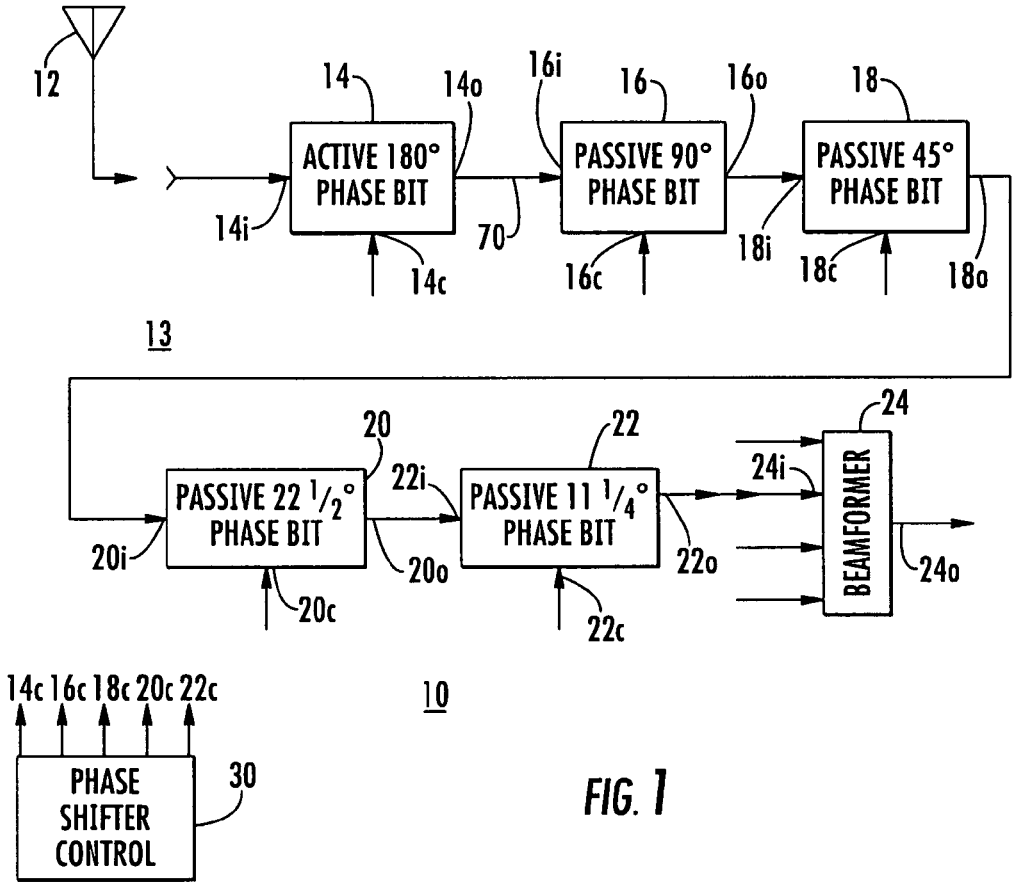
FIG. 1 is an overall block diagram of a multibit phase shifter according to an aspect of the invention, including both an active 180° phase bit and passive lesser phase bits, together with a controller therefor and a beamformer for accepting phase shifted signals from the multibit phase shifter.

In FIG. 1, a structure 10 includes an elemental antenna 12, which is part of (a portion of) an array antenna not otherwise illustrated. The explanation of the operation of the antenna is couched, for simplicity, in terms of the receiving function, but those skilled in the antenna arts know that antennas are transducers between guided and unguided waves, which have the same characteristics of operation, such as beam and impedance characteristics, in both transmission and reception.

Unguided electromagnetic radiation received or transduced by antenna 12 of FIG. 1 is coupled or guided to an input port of a multibit phase shifter 13, and more particularly to an input port 14*i* of an active 180° phase shifter illustrated as a block 14. In this context, the term "active" means that the phase shifter is capable of increasing the energy or power of the applied signal. The state of phase shifter 14 is controlled by a control signal applied to a control input port 14*c*. The signal traversing phase shifter 14 may be phase shifted by a reference amount, or it may be phase shifted by the reference amount plus 180°. The reference phase shift is often ignored, as being a constant value which can be taken into account during signal processing. For simplicity, the description of FIG. 1 assumes that the reference phase shift is zero. Thus, the signal traversing phase shifter 14 is phase shifted by 0° or by 180°, under the control of the control signal applied to its control input port 14*c*.

Multibit phase shifter 13 of FIG. 1 includes active 180° phase shifter or phase bit 14, and also includes additional phase shifters. The signal acted on (in the receive mode of operation) by phase shifter 14 is coupled from its output port 14*o* to the input port 16*i* of a passive 90° phase shifter illustrated as a block 16. The term "passive" in this context means that the phase shifter is capable only of reducing, rather than increasing, the energy or power of the applied signal. The state of phase shifter 16 is controlled by a control signal applied to its control input port 16*c*. Phase shifter 16 shifts the electromagnetic signal applied to its input port 16*i* by either reference phase shift (assumed for simplicity to be zero degrees) or reference phase shift plus 90°. The signal so acted on by 90° phase shifter 16 is coupled from its output port 16*o* to an input port 18*i* of a further passive 45° phase shifter illustrated as a block 18, the state of which is controlled by a control signal applied to its control input port 18*c*. Phase shifter 18 shifts the phase of the signal applied from phase shifter 16 by either 0° or by 45°, depending upon the state of the control signal. The signal acted on by 45° phase shifter 18 is coupled from its output port 18*o* to the input port 20*i* of a passive 22½° phase shifter 20. Phase shifter 20 shifts the phase of the signal applied to its input port 20*i* by either 0° or 22½°, depending upon the state of a control signal applied to its control signal input port 20*c*. The reference-phase or phase-shifted signal produced by phase shifter 20 is coupled from its output port 20*o* to the input port 22*i* of a passive 11¼° phase shifter 22. Phase shifter 22 shifts the phase of the signal applied to its input port 22*i* by either 0° or 11¼°, depending upon the state of the control signal applied to its control signal input port 22*c*. The output port of phase shifter 13 of FIG. 1 is output port 22*o* of phase shifter 22.

A phase shift controller is illustrated in FIG. 1 as a block 30. In an actual array antenna arrangement, there will be many elemental antennas such as antenna 12, each of which will be associated with a multibit phase shifter such as 13. Thus, controller 30 represents only that part of the overall controller which is associated with multibit phase shifter 13, and it is integrated into the larger array antenna beam direction control arrangement (not illustrated). Those skilled in the art are well aware of details of controller 30.

As mentioned, an actual array antenna arrangement includes a plurality of elemental antennas such as 12 of FIG. 1 and a like plurality of multibit phase shifters such as 13. The signals received by the elemental antennas of the array (in the receiving mode) and phase shifted by the associated multibit phase shifters are applied to a beamformer, which combines the various received and phase shifted signals in order to define directed array antenna beams. In FIG. 1, the signal received by elemental antenna 12 and phase shifted by multibit phase shifter 13 is applied from output port 22*o* to an input port of a beamformer 24. Beamformer 24 also includes a plurality of other input ports (not separately designated) for receiving other received and phase shifted signals, and for combining the signals to form a beamformed or combined signal at port 24*o* for further use.

The above description of the operation of the structure 10 of FIG. 1 assumes that the elemental antenna 12 is operated in its receive mode. In a transmitting mode of operation of the structure of FIG. 1, signal is applied to port 24*o* of beamformer 24, which thus becomes an "input" port. The signal is divided by beamformer 24 among its ports in a manner for ultimately forming a transmitted beam in the desired direction, and some of the signal appears at port 24*i* for coupling to phase shifter 13. Phase shifter 13 phase shifts the signal in the same manner as described in conjunction with receive operation, except that the signal propagates first through the bits of less significance rather than through the bits of greatest significance. The signal phase-shifted by phase-shifter 13 flows to the elemental antenna 12 for radiation and for combination with the radiation of the other elemental antennas (not illustrated).

Figure 2:
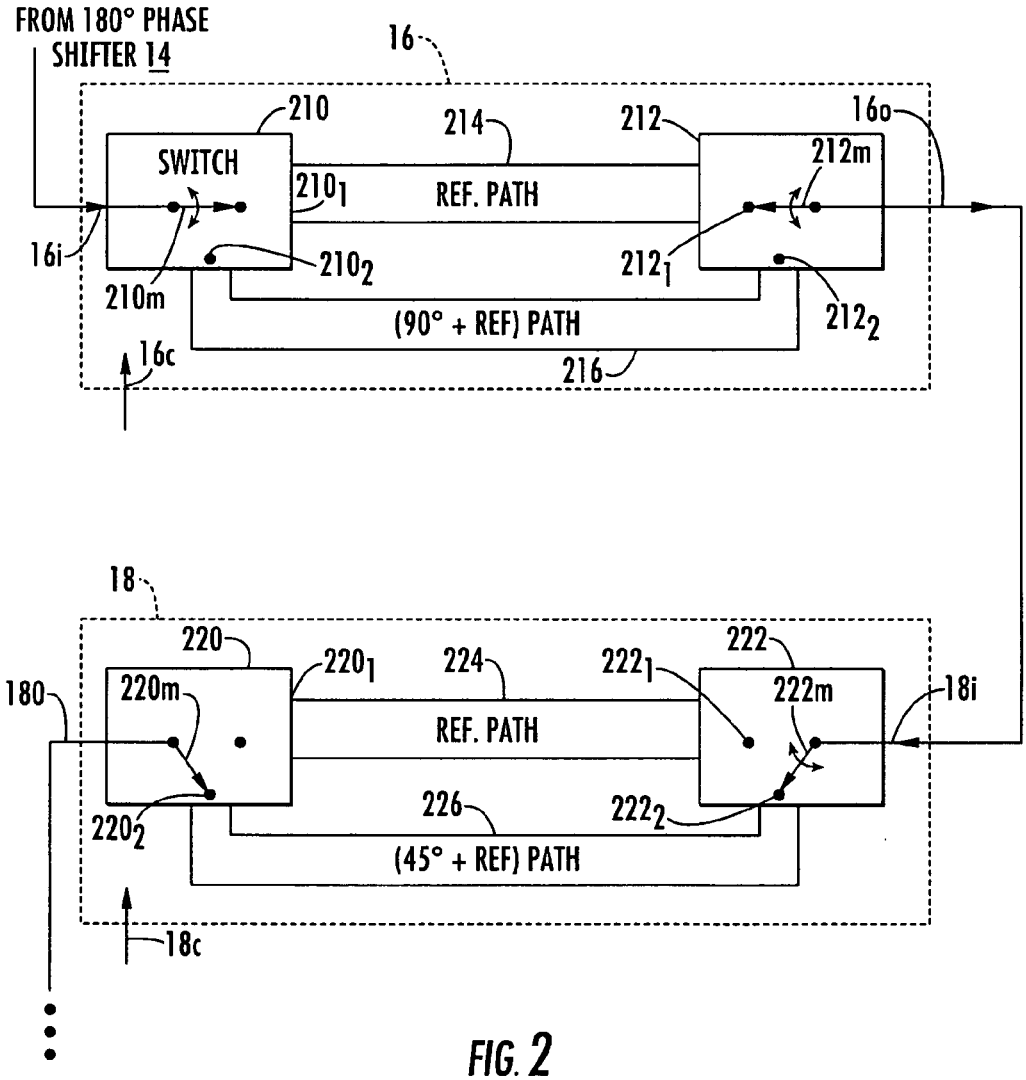
FIG. 2 is a simplified diagram in block and schematic form, illustrating a passive phase bit for use in the arrangement of FIG. 1 according to an aspect of the invention.

FIG. 2 illustrates some details of a passive phase shifter of multibit phase shifter 13 of FIG. 1. For definiteness, FIG. 2 illustrates details of phase shifters 16 and 18 of FIG. 1. In FIG. 2, passive phase shifter 16 is seen to include an "input" single-pole, double throw (SPDT) switch 210 and an "output" SPDT switch 212. While illustrated by a mechanical switch symbol, this is only for simplicity, and those skilled in the art know that electronically controlled, solid-state switches are preferred, if not mandatory, for such functions. As illustrated in FIG. 2, the input signal is applied to the "moving" portion 210*m* of switch 210, which is capable of selectively making connection to either a terminal $\mathbf{210}_1$ or a second terminal $\mathbf{210}_2$. A second similar switch 212 includes a "moving" portion 212*m*, which is capable of selectively making connection to one of a terminal $\mathbf{212}_1$ or $\mathbf{212}_2$. The "moving" or common elements of switches 210 and 212 are ganged together for simultaneous actuation, which is to say that movable elements 210*m* and 212*m* assume the illustrated state simultaneously, and simultaneously assume the non-illustrated state. A reference transmission line, illustrated as a strip conductor 214, extends between terminal $\mathbf{210}_1$ of switch 210 and terminal $\mathbf{212}_1$ of switch 212. Of necessity, reference transmission line 214 has physical length, and this accounts for the fact that it has a finite or non-zero phase shift. A further transmission line, illustrated as a strip conductor 216, extends between terminal $\mathbf{210}_2$ of switch 210 and terminal $\mathbf{212}_2$ of switch 212. Those skilled in the art know that the terms "between" and "across" as used in electrical or systems parlance do not necessarily have the same meanings as the terms when used in a physical or topological sense, but rather express the termination points of electric fields or conductors. The physical length of transmission line 216 is sufficiently longer than transmission line 214 so that it exhibits 90° of additional phase shift at the operating frequency, so that its length is (90°+reference). Since any real equipment operating at a discrete frequency must necessarily have a finite bandwidth, the "frequency" may be interpreted as being the center frequency of the operating bandwidth, or at least a frequency lying within the operating bandwidth. Thus, the signal entering input port 16*i* (for the receive mode of operation) of phase shifter 16 flows by way of switch "moving" elements 210*m* and 212*m* through either reference path 214 or phase-shift path 216, and exits phase shifter 16 at port 16*o*, having experienced either reference or (reference+90°) phase shift, under the control of a control bit applied to control input port 16*c*.

Similarly, in FIG. 2, controllably phase shifted signals from phase shifter 16 are applied to an input port 18*i* of 45° phase shifter 18. Phase shifter 18 includes first and second single-pole, double-throw switches 220 and 222, respectively, each of which includes a "movable" or common element and two selectable terminals. The signal applied to input port 18*i* of phase shifter 18 is coupled to common element 222*m* of switch 222. Depending upon the state of the switch 222, which in turn depends upon the state of the control phase bit applied to control input port 18*c*, the applied signal is applied by way of terminals 222, or 2222, respectively, to either a reference-phase transmission line 224 or a reference+45° phase shift transmission line 226. The output end of reference phase shift transmission line 224 is coupled to terminal $\mathbf{220}_1$ of switch 220, and the output end of phase shift transmission line 226 is coupled to terminal $\mathbf{220}_2$ of switch 220. The term "coupling" includes direct galvanic connection. As with phase shifter 16 of FIG. 1, the switches 220 and 222 of phase shifter 18 are ganged together for simultaneous actuation by the control bit. In operation, the control bit selects connection of switches 220 and 222 to either the reference path 224 or the phase-shifted path 226, and the phase shifted (or reference) signal appears at output port 18*o* for application to other phase bits (not illustrated). Thus, a five-bit digital control signal can control the states of each of five RF-cascaded phase shifters, and with five bits, the desired phase shift can be selected to within half of 11¼°, or about 6°.

In practice, the various elements of a phased-array antenna, and its phase shifters and control, are made in the form of solid-state elements. Everyone knows that such solid-state devices tend to be very small. This small size is very advantageous for many applications, including phase shifters for array antennas, because the weight and size reduction tends to make the equipment more amenable to portability or for use in vehicles, especially airborne or space vehicles. One major disadvantage of passive phase shifters such as those described in conjunction with FIG. 2 is that the transmission lines tend to be lossy. That is to say, that the transmission lines are merely electrical conductors of a given length, and such electrical conductors tend to exhibit attenuation in the form of resistive or "heat" losses when signal passes therethrough. These losses tend to be more of a problem when a phased-array antenna must be used in a transmission mode of operation, rather than only in a reception mode, because the power levels in a transmission mode of operation tend to be greater than in a receive mode.

Another problem with passive phase shifters using transmission lines is that the physical size of some of the transmission lines may be large. Large size is a problem, because the substrates on which many solid-state systems are made are small. As an example, the excess length (over and above the reference length) of the transmission line suitable for 180° phase shift at 1 GHz may be as great as 6 inches for the case of air dielectric. The presence of the solid-state substrate may reduce this minimum length, and the excess length at higher frequencies is proportionally smaller. However, even lesser lengths may be in excess of those that can be conveniently incorporated into a solid-state RF structure.

According to an aspect of the invention, at least the greatest phase bit of a multibit phase shifter is made as an active phase bit using an active device, and the remainder are passive phase bits. In the optimum case, the active phase bit has gain, thereby tending to offset or compensate for the losses in the passive phase bits of the phase shifter.

Figure 3A:
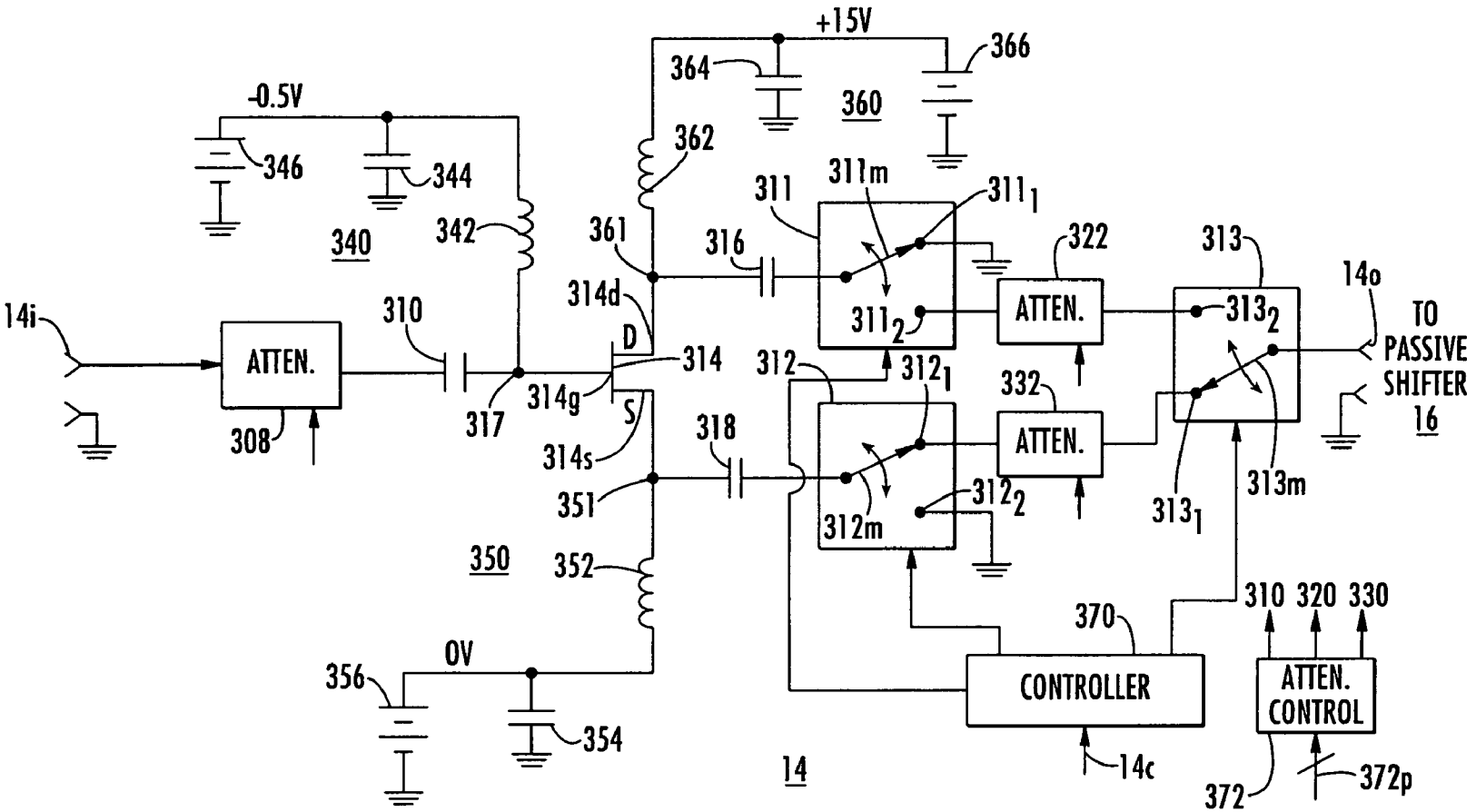
FIG. 3*a* is a simplified diagram in block and schematic form, illustrating an active 180° passive phase bit, in the 0° condition, for use in the arrangement of FIG. 1 according to an aspect of the invention.

FIG. 3*a* is a simplified schematic diagram of an active 180° phase shifter or phase bit which may be used as the active phase bit 14 of FIG. 1. In FIG. 3*a*, signal originating from antenna element 12 of FIG. 1 (in a receiving mode of operation) is applied by way of input port 14*i* of active 180° phase bit 14 to an attenuator illustrated as a block 310, well known in the art. Block 310 attenuates the applied signal, and passes the signal so attenuated through an RF coupling, DC blocking capacitor 312 to a node 317 and to the gate 314*g* of a field-effect transistor (FET) 314.

The RF signal applied to gate 314*g* of FET 314 is coupled out-of-phase or with a 180° phase shift to the drain 314*d* of FET 314, and thence by way of a node 361 and an RF coupling, DC blocking capacitor 316 to the common or movable element 311*m* of a switch 311. Common or movable element 311*m* of switch 311 can selectively contact a switch terminal $\mathbf{311}_1$ and a switch terminal $\mathbf{311}_2$. Switch terminal $\mathbf{311}_1$ is coupled to a reference potential, illustrated as ground. Switch terminal $\mathbf{311}_2$ is coupled by way of an attenuator illustrated as a block 322 to a terminal $\mathbf{313}_2$ of a switch 313.

The RF signal applied to gate 314*g* of FET 314 of FIG. 3*a* is also coupled in-phase (0° phase shift) to the source 314*s* of FET 314, and thence by way of a node 351 and an RF coupling, DC blocking capacitor 318 to the common or movable element 312*m* of a switch 312. Common or movable element 312*m* of switch 312 can selectively contact a switch terminal 312, and a switch terminal $\mathbf{312}_2$. Switch terminal $\mathbf{312}_2$ is coupled to a reference potential, illustrated as ground. Switch terminal $\mathbf{312}_1$ is coupled by way of an attenuator illustrated as a block 332 to a terminal $\mathbf{313}_2$ of switch 313.

Switch 313 of active 180° phase shifter 14 of FIG. 3*a* receives 180° phase shifted signal at its input terminal $\mathbf{313}_2$ and reference—or 0°—phase signal at its input terminal $\mathbf{313}_1$, and includes a common or movable element 313*m* which selectively contacts either terminal 313, or terminal 3132, and couples to output terminal 14*o* either the 180° phase shifted signal or the reference- or 0'-phase signal. The output terminal 14*o* couples the signal phase-shifted (or not phase shifted) signal to passive phase shifter 16 of FIG. 1.

A gate bias source designated generally as 340 in FIG. 3*a* is coupled by way of node 317 to gate 314*g*. Gate bias source 340 includes a bias voltage source, conventionally illustrated as a battery symbol 346, coupled by way of a high-RF-impedance, low-DC-resistance element illustrated as an inductor 342 to node 317 and thence to gate 314*g*. A filter capacitor 344 is coupled between voltage source 346 and a reference voltage source illustrated by a ground symbol. A source bias source designated generally as 350 in FIG. 3*a* includes a voltage source 356 coupled by way of a high-RF-impedance, low-DC resistance element 352 and node 351 to the source 314*s* of FET 314. A filter capacitor 354 is coupled between voltage source 356 and ground.

A drain bias source designated generally as 360 in FIG. 3*a* is coupled by way of node 361 to drain 314*d* of FET 314. Drain bias source 360 includes a bias voltage source 366 coupled by way of a high-RF-impedance, low-DC-resistance element illustrated as an inductor 362 to node 361 and drain 314*d*. A filter capacitor 364 is coupled between voltage source 366 and a reference voltage source illustrated by a ground symbol.

In operation of the phase shifter 14 of FIG. 3*a*, bias voltages and currents make FET 314 active. In one embodiment, the gate bias voltage is 0.5 volts, the drain bias voltage is 15 volts, and the source bias voltage is 0 volts. The phase shifting operation depends upon the states of the switches 320, 324, and 330, which in turn depends upon the state of a control bit applied by way of control input port 14*c* to a controller illustrated as a block 370. More particularly, when reference or zero phase shift is commanded by the control bit applied by way of control port 14*c* to controller 370, controller 370 commands switches 320, 324, and 330 to the states illustrated in FIG. 3*a*, in which common or movable element 311*m* makes contact with terminal $\mathbf{311}_1$, movable element 312*m* makes contact with terminal $\mathbf{312}_1$, and movable element 313*m* makes contact with terminal $\mathbf{313}_1$. In the illustrated state, no 180° signal from the drain 312*d* of FET 314 is coupled toward output port 14*o*, because the state of switch 311 couples all such signal to ground, and not to output switch 313. Signal from the source of FET 314, which is the 0° signal, is coupled through switch 312, attenuator 332, and switch 313 to output port 14*o*.

Figure 3B:
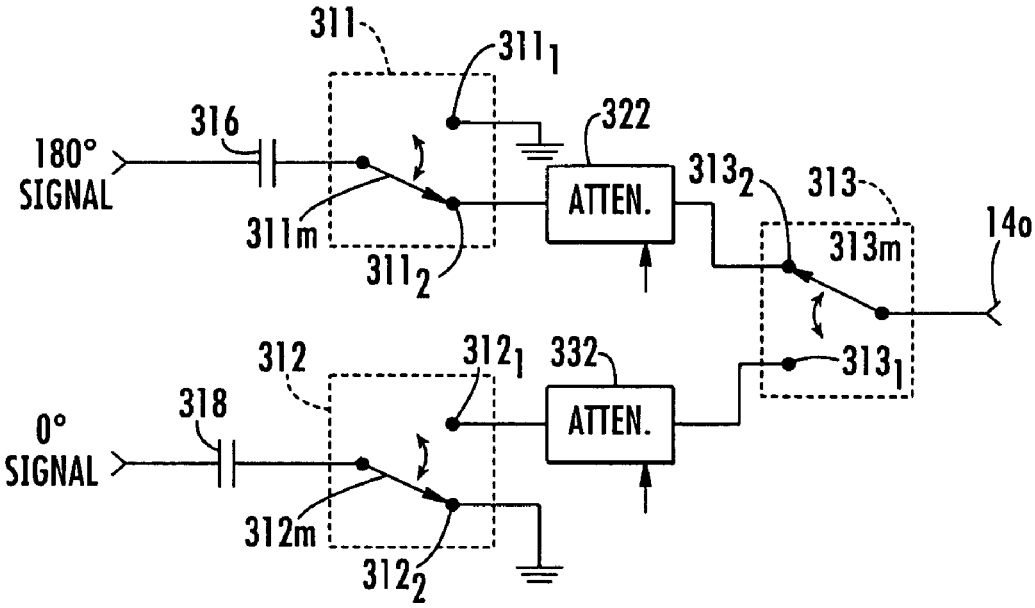
FIG. 3*b* illustrates a portion of FIG. 3*a* showing the 180° condition.

FIG. 3*b* illustrates the states of switches 311, 312, and 313 in a state different from that illustrated in FIG. 3*a*. More particularly, the states of switches 311, 312, and 313 are those for coupling of the 180° signal to the output port of the active phase shifter. In FIG. 3*b*, the 180° signal (from the drain of FET 314 of FIG. 3*a*) is applied through DC blocking, RF passing capacitor 316 to the common element 311*m* of switch 311. Common element 311*m* contacts terminal $\mathbf{311}_2$, so the 180° signal flows to attenuator 322 and thence to switch terminal $\mathbf{313}_2$ of switch 313. In the switch state illustrated in FIG. 3*b*, common element 313*m* makes contact with switch terminal $\mathbf{313}_2$ of switch 313. Consequently, the 180° signal flows through switches 311 and 313 to output port 14*o* of active phase shifter 14. The 0° signal (originating from the source of FET 314 of FIG. 3*a*) flows through DC blocking, RF coupling capacitor 318 to common element 312*m* of switch 312, which in the illustrated state of switch 312 simply couples the 0° signal to ground. Thus, the 0° signal cannot progress to output switch 313. Consequently, the state of switches 311, 312, and 313 illustrated in FIG. 3*b* couples only the 180° signal to output port 14*o*, and not the 0° signal.

Those skilled in the art know that FET 314 of FIG. 3*a* can produce amplified signal in addition to providing a 180° phase shift. Thus, the signal at the source 314*s*, the drain 314*d*, or both may be amplified relative to the applied input signal. This can be taken advantage of to help to overcome the attenuation or heat losses of the passive phase shifters with which active phase shifter is cascaded (see FIG. 1).

As so far described, active phase shifter controller 370 controls the state of switches 311, 312, and 313 under the control of a state control signal applied to control input port 14*c*. However, there are four passive phase bits in the particular 5-bit phase shifter of the example. These passive phase bits each exhibit different attenuation or heat loss. Thus, depending upon the state of the multibit phase shifter, there may be four different attenuation states attributable to the passive phase bits. According to an aspect of the invention, attenuators 310, 320, and 330 are controllable, and have their attenuation adjusted under the control of an attenuation controller. The attenuation controller is illustrated as a block 372 in FIG. 3*a*, and includes connections to each of attenuators 310, 320, and 330 for control of the attenuation under the control of control signals applied by way of a path 372*p*. The attenuation control signals may be in the form of actual attenuation magnitude signals, or they may be in the form of an indication of which passive phase bits are in the engaged or ON state. In either case, attenuation control block 372 can make the computations to determine the amount of attenuation which are appropriate for each of the attenuators in order to have a particular value of gain or loss, or preferably a net gain of unity (zero attenuation or gain).

Figure 4A:
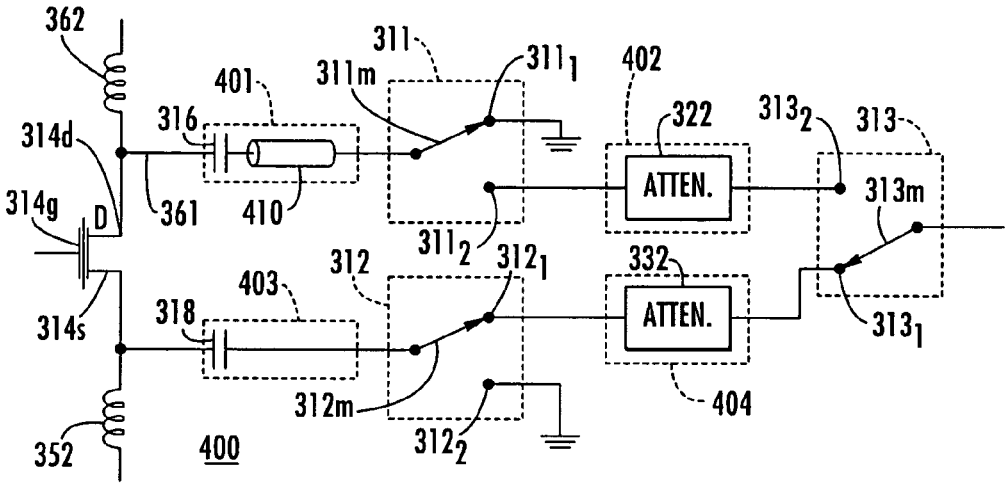
FIG. 4*a* illustrates a portion of the arrangement of FIG. 3*a* with additional signal paths.
Figure 4B:
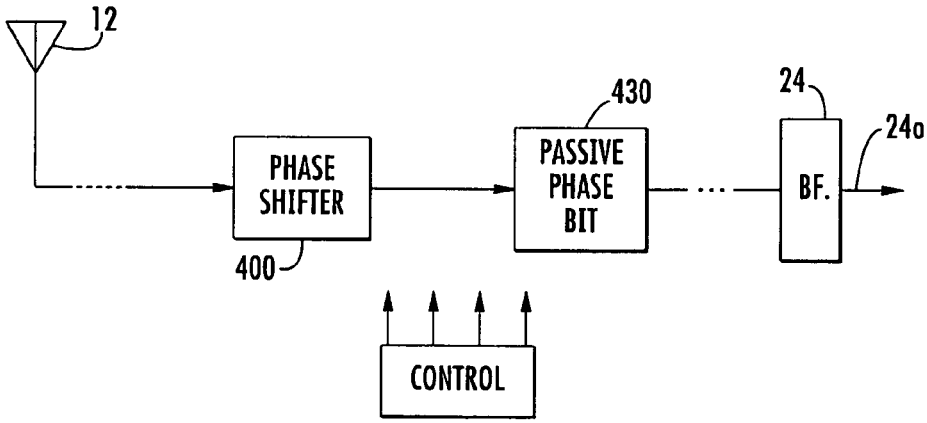
FIG. 4*b* is a diagram equivalent to that of FIG. 1 showing how the phase shifter of FIG. 4*a* can be used in conjunction with passive phase shifters.

FIG. 4*a* illustrates another embodiment according to an aspect of the invention. Elements of FIG. 4*a* corresponding to those of FIG. 3*a* or 3*b* are designated by corresponding reference alphanumerics. In FIG. 4*a*, the path for signal flow between the drain 314*d* of FET device 314 and the common terminal 311*m* of switch 311 is illustrated as a dash-line rectangle 401, representing a first signal path. Similarly, the path for signal flow between terminal $\mathbf{311}_2$ of switch 311 and terminal $\mathbf{313}_2$ of switch 313 is designated 402, representing a second signal path. The path for signal flow between the source 314*s* of FET device 314 and the common terminal 312*m* of switch 312 is illustrated as a dash-line rectangle 403, representing a third signal path, and the path for signal flow between terminal $\mathbf{312}_1$ of switch 312 and terminal $\mathbf{313}_1$ of switch 313 is designated 404, representing a fourth signal path. As illustrated in FIG. 4*a*, the second, third and fourth signal paths 402, 403, and 404, respectively, are the same as the corresponding paths in FIG. 3*a*, in that path 402 includes only capacitor 318, path 403 includes only attenuator 322, and path 404 includes only attenuator 332. By contrast, path 401 of FIG. 4*a* includes a transmission line element designated 410. The purpose of introducing transmission line element 410 is to introduce a phase shift into the signal path 401, and therefore into the signal path extending from drain 314*d* to switch terminal 313*m* when switches 311 and 313 are in their alternate states (not illustrated). The introduction of a phase shift, say of $\phi°$, into this path tends to increase the phase difference occurring in the nominal 180° state to a value greater than 180°, or more specifically to 180° plus $\phi°$. The introduction of a phase shift $\phi°$ into signal path 402 instead of into signal path 401 will have the same effect. Introduction of a $\phi°$ phase shift into either of signal paths 403 or 404, by contrast, has the effect of reducing the phase shift experienced upon switching from 180° to $180°-\phi°$. As a more concrete example, if the phase shift introduced by element 410 of FIG. 4*a* is selected to be 90°, the phase shift in the nominal 180° switching position will be 270°, for a phase difference of −90 relative to the reference value. If the 90° phase element 410 were to be introduced instead into path 403 or 404, the phase shift in the nominal 180° switching position would be 180', and the reference phase shift would be 90°, for a phase difference of +90°. Naturally, other phase increments can be used, such as 45°, or any other value. With a 45° phase increment provided by element 410 in path 401, the phase difference is 225 or −135°, and if the 45° phase increment is provided in path 403 or 404, the phase difference is +135°. Those skilled in the art will recognize that such excess phase shift elements can be introduced into any or all of the signal paths 401, 402, 403, 404, and know how to determine the resulting phase increment or difference. FIG. 4*b* illustrates a multibit phase shifter generally similar to that of FIG. 1, in which a phase shifter 400 such as that of FIG. 4*a* is cascaded with one or more passive phase shifters 430.

A controllable RF phase shifter (10) according to an aspect of the invention comprises a controllable active RF phase bit (14) including an RF path (311, 312, 313, 314) having a first phase increment (0° or 180°). The phase shifter (10) also includes a controllable passive RF phase bit (16) including an RF path (214, 216) having a second phase increment (0°, 90°) different from the first phase increment (0°, 180°). RF coupling means (70) are coupled to the active (14) and passive (16) RF phase bits, for coupling the RF paths of the active and passive phase bits in cascade. Control means (30) are coupled to the active (14) and passive (16) phase bits for controlling each of the active (14) and passive (16) RF phase bits to one of first and second states, for thereby imposing upon RF signal traversing the cascade the first phase increment (180°), the second phase (90°) increment, the sum of the first and second phase increments (270°), or no phase increment (0°).

A phase shifter (14) according to an aspect of the invention comprises a solid-state device (314) including a path (314*s* to 314*d*) for the flow of electrical current between first (314*d*) and second (314*s*) electrodes and a control electrode (314*g*) for controlling the flow of current through the path. A source (12) of signal to be phase shifted is coupled to the control electrode (314*g*) of the device, for controlling the flow of current through the path in response to the signal in such a manner that first electrode (314*d*) signal appearing at the first electrode (314*d*) in response to the signal coupled to the control electrode (314*g*) is in a first phase state (180°) relative to the signal at the control electrode, and in such a manner that second electrode (314*s*) signal appearing at the second electrode (314*s*) in response to the signal coupled to the control electrode (314*g*) is in a second phase state (0°), different from the first phase state (180°). A first switch (311) includes a common terminal (311*m*) coupled to the first electrode (314*d*) of the device (314) and a first independent terminal ($\mathbf{311}_1$) coupled to reference potential, and also includes a second independent terminal ($\mathbf{311}_2$), for, in a first state (180°) of the first switch (311), coupling the first electrode (314*d*) of the device (314) to the second independent terminal ($\mathbf{311}_2$) of the first switch (311), and for, in a second state (0°), coupling the first electrode (314*s*) of the device (314) to the reference potential. A second switch (312) includes a common terminal (312*m*) coupled to the second electrode (314*s*) of the device (314) and a first independent terminal ($\mathbf{312}_1$), and also includes a second independent terminal ($\mathbf{312}_2$) coupled to reference potential, for, in a first state (180°) of the second switch (312), coupling the second electrode (314*s*) of the device 9314) to the second independent terminal ($\mathbf{312}_2$) of the second switch (312), and for, in a second state (0°) of the second switch (312), coupling the second electrode (314*s*) of the device (314) to the first independent terminal ($\mathbf{312}_1$) of the second switch (312). A third switch (313) includes a common terminal (313*m*), and first ($\mathbf{313}_1$) and second ($\mathbf{313}_2$) independent terminals. The first independent terminal ($\mathbf{313}_1$) of the third switch (313) is coupled to the first independent terminal ($\mathbf{312}_1$) of the second switch (312) and the second independent terminal ($\mathbf{313}_2$) of the third switch (313) is coupled to the second independent terminal ($\mathbf{311}_2$) of the first switch (311). The third switch (313) connects the common terminal (313*m*) of the third switch (313) to the second independent terminal ($\mathbf{313}_2$) of the third switch (313) in a first state (180°) of the third switch (313), and connects the common terminal (313*m*) of the third switch (313) to the first independent terminal ($\mathbf{313}_1$) of the third switch (313) in the second state (0°) of the third switch (313). Control means (370) are coupled to the first (311), second (312), and third (313) switches, for, in a first nominal phase condition (180°), simultaneously controlling the first (311), second (312), and third (313) switches to the first states (180°) of the first (331), second (312) and third (313) switches, and for, in a second nominal phase condition (0°), simultaneously controlling the first (311), second (312), and third (313) switches to the second states (0°) of the first (311), second (312), and third (313) switches.

In a particularly advantageous embodiment of this aspect of the invention, the first phase state is 180° and the second phase state is 0°.

A phase shifter (14) according to an aspect of the invention comprises a solid-state device (314) including a path (source to drain) for the flow of electrical current between first (314*d*) and second (314*s*) electrodes, and also includes a control electrode (314*g*) for controlling the flow of current through the path (source to drain). The phase shifter (14) also includes a source (14*i*) of signal to be phase shifted. The source (14*i*) of signal is coupled to the control electrode (314*g*) of the device (314), for controlling the flow of current through the path (source to drain) in response to the signal in such a manner that first electrode (314*d*) signal appearing at the first electrode (314*d*) in response to the signal coupled to the control electrode (314*g*) is nominally out-of-phase relative thereto, and in such a manner that second electrode (314*s*) signal appearing at the second electrode (314*s*) in response to the signal coupled to the control electrode (314*g*) is nominally in-phase relative thereto. The phase shifter (14) also includes a first switch (311) including a common terminal (311*m*) coupled to the first electrode (314*d*) of the device and a first independent terminal ($\mathbf{311}_1$) coupled to reference potential (ground). The first switch (311) also includes a second independent terminal ($\mathbf{311}_2$). The first switch (311), in a first state (180°) of the first switch (311), couples the first electrode (314*d*) of the device (314) to the second independent terminal (3112) of the first switch (311), and in a second state (0°), couples the first electrode (314*d*) of the device (314) to the reference potential (ground). A second switch (312) includes a common terminal (312*m*) coupled to the second electrode (314*s*) of the device (314) and also includes a first independent terminal ($\mathbf{312}_1$), and also includes a second independent terminal ($\mathbf{312}_2$) coupled to reference potential (ground). The second switch (312), in a first state (180°) of the second switch (312), couples the second electrode (314*s*) of the device (314) to the second independent terminal ($\mathbf{312}_2$) of the second switch (312), and in a second state (0°) of the second switch (312), couples the second electrode (314*s*) of the device (314) to the first independent terminal ($\mathbf{312}_1$) of the second switch (312). A third switch (313) includes a common terminal (313*m*), and first ($\mathbf{313}_1$) and second ($\mathbf{313}_2$) independent terminals. The first ($\mathbf{313}_1$) independent terminal of the third switch is coupled to the first independent terminal ($\mathbf{312}_1$) of the second switch (312), and the second independent terminal ($\mathbf{312}_2$) of the third switch is coupled to the second independent terminal ($\mathbf{311}_2$) of the first switch (311). The third switch (313) connects the common terminal (313*m*) of the third switch (313) to the second independent terminal ($\mathbf{313}_2$) of the third switch in a first state (180°) of the third switch (313), and connects the common terminal (313*m*) of the third switch (313) to the first independent terminal ($\mathbf{313}_1$) of the third switch in the second state (0°) of the third switch (313). Control means are coupled to the first (311), second (312), and third (313) switches, for, in a 180° condition, simultaneously controlling the first (311), second (312), and third (313) switches to the first states of the first (311), second (312), and third (313) switches, and for, in a 0° condition, simultaneously controlling the first (311), second (312), and third (313) switches to the second states (0°) of the first (311), second (312), and third (313) switches.

An active electromagnetic RF phase bit (14) according to another aspect of the invention comprises a FET (314) including source (314*s*), drain (314*d*), and gate (314*g*) electrodes, and direct-current biasing means (340, 350, 360) coupled to the source (314*s*), drain (314*d*), and gate (314*g*)

electrodes, for providing biasing energization to the FET (314). Source (314*s*), drain (314*d*), and gate (314*g*) direct-current blocking means (318, 316, 310) are coupled to the source (314*s*), drain (314*d*), and gate (314*g*), respectively, of the FET (314), for providing RF ports into the bias energized source (314*s*), drain (314*d*), and gate (314*g*) electrodes of the FET (314). An RF signal input path (14*i*, 308) is coupled to the gate (314*g*) direct-current blocking means (310), whereby electromagnetic RF applied to the RF input port (14*i*) is coupled to the gate (314*g*) electrode of the FET (314). The RF phase bit (14) also includes first (311), second (312), and third (313) three-port, single-pole, double-throw RF switches, each including a common or "movable" port (311*m*, 312*m*, 313*m*) and also including first ($\mathbf{311}_1$, $\mathbf{312}_1$, $\mathbf{313}_1$) and second ($\mathbf{311}_2$, $\mathbf{312}_2$, and $\mathbf{313}_2$) individual ports to which the common port (311*m*, 312*m*, 313*m*) is connected in first (0°) and second (180°) states, respectively, of the RF switches. The common port (311*m*) of the first RF switch (311) is coupled or connected to the drain (314*d*) direct-current blocking means (316), and the first individual port ($\mathbf{311}_1$) of the first RF switch (311) is coupled or connected to an RF reference potential such as ground. The common port (312*m*) of the second RF switch (312) is coupled to the source (314*s*) direct-current blocking means (318), and the second individual port ($\mathbf{312}_2$) of the second RF switch (312) is coupled or connected to RF reference potential. The RF phase bit (14) includes first coupling means (322) coupling the second individual port ($\mathbf{313}_2$) of the third RF switch (313) to the second individual port ($\mathbf{311}_2$) of the first RF switch (311), and second coupling means (332) coupling the first individual port ($\mathbf{313}_1$) of the third RF switch (313) to the first individual port ($\mathbf{312}_1$) of the second RF switch (312). An RF output signal path (14*o*) is coupled to the common port (313*m*) of the third RP switch (313). Control means (370) are provided, coupled to the first (311), second (312), and third (313) RF switches, for causing the third RF switch (313) to assume the first state in response to a request for a reference phase condition (0°) and the second state (180°) in response to a request for a 180° reference phase condition, and for causing the first and second RF switches to assume the first state in response to a request for a reference phase condition and the second state in response to a request for a 180° phase condition.

In a particular embodiment of this aspect of the invention, each of the first (322) and second (332) coupling means comprises an RF attenuator, which may be controllable. Each of the source (314*s*) and drain (314*d*) direct-current blocking means (316, 318) may comprise a capacitor. In one embodiment, each of the direct-current biasing means (340, 350, 360) coupled to the source (314*s*), drain (314*d*), and gate (314*g*) electrodes, respectively, comprises at least an impedance element (342, 352, 362), exhibiting an impedance of at least 250 ohms at operational frequencies of the phase bit, coupled to the source (314*s*), drain (314*d*), and gate (314*g*) electrodes, respectively, and to at least one bias voltage source (314*s*). A preferred version of this aspect of the invention includes, in each of the direct-current biasing means (340, 350, 360) coupled to the source (314*s*), drain (314*d*), and gate (314*g*) electrodes, respectively, a capacitor (344, 354, 364) coupled the impedance element (342, 352, 362) and to the reference potential.

According to another aspect of the invention, a multibit RF phase shifter (10) comprises a phase shifter path (14, 16, . . . ) for the flow of RF signal between first (14*i*) and second (22*o*) phase shifter ports. The multibit RF phase shifter (10) includes a passive first phase bit (16) having a phase increment of less than 180° relative to a reference value. The first phase bit (16) comprises first (214) and second (216) differing lengths of transmission line, and first bit switching means (210, 212) coupled to the first (214) and second (216) lengths of transmission line for, in a first state (0°) of the first phase bit (16), connecting the first length (214) of transmission line in the first path, and for, in a second state (180°) of the first phase bit (16), connecting the second length (216) of transmission line in the phase shifter path. The multibit RF phase shifter (10) also includes an active second RF phase bit (14). The active second RF phase bit (14) comprises a FET (314) including source (314*s*), drain (314*d*), and gate (314*g*) electrodes, and direct-current biasing means (340, 350, 360) coupled to the source (314*s*), drain (314*d*), and gate (314*g*) electrodes, for providing biasing energization to the FET (314). The multibit RF phase shifter also includes source (314*s*), drain (314*d*), and gate (314*g*) direct-current blocking means coupled to the source (314*s*), drain (314*d*), and gate (314*g*), respectively, of the FET (314), for providing RF paths, but not direct-current paths, to the bias energized source (314*s*), drain (314*d*), and gate (314*g*) electrodes of the FET (314). A second RF signal path is coupled to the gate (314*g*) direct-current blocking means, whereby electromagnetic RF applied to a second phase bit RF input port is coupled to the gate (314*g*) electrode of the FET (314). First (311), second (312), and third (313) three-port, single-pole, double-throw RF switches each include a common port (311*m*, 312*m*, 313*m*), and first ($\mathbf{311}_1$, $\mathbf{312}_1$, $\mathbf{313}_1$) and second individual ports ($\mathbf{311}_2$, $\mathbf{312}_2$, $\mathbf{313}_2$) to which the common port (311*m*, 312*m*, 313*m*) is connected in first (0°) and second (180°) states, respectively, of the RF switches. The common port (311*m*) of the first RF switch (311) is coupled to the drain (314*d*) direct-current blocking means (316), and the first individual port ($\mathbf{311}_1$) of the first RF switch (311) is connected to RF reference potential. The common port (312*m*) of the second RF switch (312) is coupled to the source (314*s*) direct-current blocking means (318), and the second individual port (3122) of the second RF switch (312) is connected to RF reference potential. A first coupling means (322) couples the second individual port ($\mathbf{313}_2$) of the third RF switch (313) to the second port ($\mathbf{311}_2$) of the first RF switch (311), and second coupling means (332) couples the first individual port (3131) of the third RF switch (313) to the first individual port ($\mathbf{312}_1$) of the second RF switch (312). Second RF phase bit control means (370) are coupled to the first (311), second (312), and third (313) RF switches for causing the third RF switch (313) to assume the first state (0°) in response to a request for a nominal 0° phase condition and the second state (180°) in response to a request for a nominal 180° phase condition, and for causing the first (311) and second (312) RF switches to assume the first state (0°) in response to a request for a reference phase condition and the second state (180°) in response to a request for a 180° phase condition. Second RF phase bit connection means (14*o*, 70) are coupled to the phase shifter (14) path, to the RF input port and to the common port (312*m*) of the third RF switch, for cascading the first phase bit with the second phase bit.

In a particularly advantageous version of this aspect of the invention, the first phase bit (16) includes no active element other than switching element(s).

A phase shifter (400) according to another aspect of the invention comprises a solid-state device (314) including a path (314*s* to 314*d*) for the flow of electrical current between first (314*d*) and second (314*s*) electrodes and a control electrode (314*g*) for controlling the flow of current through the path (314*s* to 314*d*). The phase shifter (400) also includes a source (12) of signal to be phase shifted, the source (12)

of signal being coupled to the control electrode (314*g*) of the device (314), for controlling the flow of current through the path (314*s* to 314*d*) in response to the signal in such a manner that first electrode (314*d*) signal appearing at the first electrode (314*d*) in response to the signal coupled to the control electrode (314*g*) is in a first phase state (180°) relative thereto, and in such a manner that second electrode (314*s*) signal appearing at the second electrode (314*s*) in response to the signal coupled to the control electrode (314*g*) is in a second phase state (0°), different from the first phase state (180°). A first switch (311) includes a common terminal (311*m*) coupled to the first electrode (314*d*) of the device (314) and a first independent terminal ($\mathbf{311}_1$) coupled to reference potential (ground), and also includes a second independent terminal ($\mathbf{311}_2$), for, in a first state (180°) of the first switch (311), coupling the first electrode (314*d*) of the device (314) to the second independent terminal ($\mathbf{311}_2$) of the first switch (311) to thereby define a first signal path (361, 316, 311*m*, $\mathbf{311}_2$) for the flow of signal from the first electrode (314*d*) of the device (314) to the second independent terminal ($\mathbf{311}_2$) of the first switch (311), and for, in a second state (0°), coupling the first electrode (314*d*) of the device (314) to the reference potential (ground). A second switch (312) includes a common terminal (312*m*) coupled to the second electrode (314*s*) of the device (314) and a first independent terminal ($\mathbf{312}_1$), and also includes a second independent terminal ($\mathbf{312}_2$) coupled to reference potential (ground), for, in a first state (180°) of the second switch (312), coupling the second electrode (314*s*) of the device (314) to the second independent terminal ($\mathbf{312}_2$) of the second switch (312), and for, in a second state (0°) of the second switch (312), coupling the second electrode (314*s*) of the device (314) to the first independent terminal ($\mathbf{312}_1$) of the second switch (312), thereby defining a second signal path (351, 318, 312*m*, $\mathbf{312}_1$) for the flow of signal from the second electrode (314*s*) of the device (314) to the second independent terminal ($\mathbf{312}_2$) of the second switch (312). A third switch (313) includes a common terminal (313*m*), and first ($\mathbf{313}_1$) and second ($\mathbf{313}_2$) independent terminals. The first independent ($\mathbf{313}_1$) terminal of the third switch (313) is coupled by a fourth signal path (332) to the first independent terminal ($\mathbf{312}_1$) of the second switch (312), and the second independent terminal ($\mathbf{313}_2$) of the third switch (313) is coupled by a third signal path (322) to the second independent terminal ($\mathbf{311}_2$) of the first switch (311). The third switch (313) connects the common terminal (313*m*) of the third switch (313) to the second independent terminal ($\mathbf{313}_2$) of the third switch (313) in a first state (180°) of the third switch (313), and connects the common terminal (313*m*) of the third switch (313) to the first independent terminal ($\mathbf{313}_1$) of the third switch (313) in the second state (0°) of the third switch (313). Control means (370) are coupled to the first (311), second (312), and third (313) switches, for, in a first nominal phase condition (180°), simultaneously controlling the first (311), second (312), and third (313) switches to the first states (180°) of the first (311), second (312), and third (313) switches, and for, in a second nominal phase condition (0°), simultaneously controlling the first (311), second (312), and third (313) switches to the second states (0°) of the first (311), second (312), and third (313) switches. A passive phase introducing element (410) is coupled in at least one of the first (401), second (402), third (403) and fourth (404) signal paths, for modifying the phase difference occurring upon simultaneous control by the control means between the first (180°) and second (0°) nominal phase conditions to be other than 180°. In a particularly advantageous embodiment of this embodiment of the invention, the first phase state (180°) of the first electrode signal (314*d*) appearing at the first electrode (314*d*) in response to the signal coupled to the control electrode (314*g*) is nominally 180°, and the second phase state (0°) of the second electrode signal (314*s*) appearing at the second electrode (314*s*) in response to the signal coupled to the control electrode (314*g*) is nominally 0°. Such a phase shifter may further include or be associated with a controllable passive RF phase bit including an RF path having a second phase increment different from the phase difference.

What is claimed is:

1. A phase shifter, comprising:

a solid-state device including a path for the flow of electrical current between first and second electrodes and a control electrode for controlling the flow of current through said path;

a source of signal to be phase shifted, said source of signal being coupled to said control electrode of said device, for controlling the flow of current through said path in response to said signal in such a manner that first electrode signal appearing at said first electrode in response to said signal coupled to said control electrode is in a first phase state relative thereto, and in such a manner that second electrode signal appearing at said second electrode in response to said signal coupled to said control electrode is in a second phase state, different from said first phase state;

a first switch including a common terminal coupled to said first electrode of said device and a first independent terminal coupled to reference potential, and also including a second independent terminal, for, in a first state of said first switch, coupling said first electrode of said device to said second independent terminal of said first switch, and for, in a second state, coupling said first electrode of said device to said reference potential;

a second switch including a common terminal coupled to said second electrode of said device and a first independent terminal, and also including a second independent terminal coupled to reference potential, for, in a first state of said second switch, coupling said second electrode of said device to said second independent terminal of said second switch, and for, in a second state of said second switch, coupling said second electrode of said device to said first independent terminal of said second switch;

a third switch including a common terminal, and first and second independent terminals, said first independent terminal of said third switch being coupled to said first independent terminal of said second switch and said second independent terminal of said third switch being coupled said second independent terminal of said first switch, said third switch connecting said common terminal of said third switch to said second independent terminal of said third switch in a first state of said third switch, and connecting said common terminal of said third switch to said first independent terminal of said third switch in said second state of said third switch; and control means coupled to said first, second, and third switches, for, in a first nominal phase condition, simultaneously controlling said first, second, and third switches to said first states of said first, second, and third switches, and for, in a second nominal phase condition, simultaneously controlling said first, second, and third switches to said second states of said first, second, and third switches.

2. A phase shifter according to claim 1, wherein said first phase state of said first electrode signal appearing at said first electrode in response to said signal coupled to said control electrode is nominally 180°, and said second phase state of said second electrode signal appearing at said second electrode in response to said signal coupled to said control electrode is nominally 0°.

3. A phase shifter, comprising:

a solid-state device including a path for the flow of electrical current between first and second electrodes and a control electrode for controlling the flow of current through said path;

a source of signal to be phase shifted, said source of signal being coupled to said control electrode of said device, for controlling the flow of current through said path in response to said signal in such a manner that first electrode signal appearing at said first electrode in response to said signal coupled to said control electrode is out-of-phase relative thereto, and in such a manner that second electrode signal appearing at said second electrode in response to said signal coupled to said control electrode is in-phase relative thereto;

a first switch including a common terminal coupled to said first electrode of said device and a first independent terminal coupled to reference potential, and also including a second independent terminal, for, in a first state of said first switch, coupling said first electrode of said device to said second independent terminal of said first switch, and for, in a second state, coupling said first electrode of said device to said reference potential;

a second switch including a common terminal coupled to said second electrode of said device and a first independent terminal, and also including a second independent terminal coupled to reference potential, for, in a first state of said second switch, coupling said second electrode of said device to said second independent terminal of said second switch, and for, in a second state of said second switch, coupling said second electrode of said device to said first independent terminal of said second switch;

a third switch including a common terminal, and first and second independent terminals, said first independent terminal of said third switch being coupled to said first independent terminal of said second switch and said second independent terminal of said third switch being coupled said second independent terminal of said first switch, said third switch connecting said common terminal of said third switch to said second independent terminal of said third switch in a first state of said third switch, and connecting said common terminal of said third switch to said first independent terminal of said third switch in said second state of said third switch; and control means coupled to said first, second, and third switches, for, in a 180° condition, simultaneously controlling said first, second, and third switches to said first states of said first, second, and third switches, and for, in a 0° condition, simultaneously controlling said first, second, and third switches to said second states of said first, second, and third switches.

4. An active electromagnetic RF phase bit, comprising:

a FET including source, drain, and gate electrodes:

direct-current biasing means coupled to said source, drain, and gate electrodes, for providing biasing energization to said FET;

source, drain, and gate direct-current blocking means coupled to said source, drain, and gate, respectively, of said FET, for providing RF ports into said bias energized source, drain, and gate electrodes of said FET;

an RF signal input path coupled to said gate direct-current blocking means, whereby electromagnetic RF applied to said RF input port is coupled to said gate electrode of said FET;

first, second, and third three-port, single-pole, double-throw RF switches, each including a common port, and first and second individual ports to which said common port is coupled in first and second states, respectively, of the RF switch;

said common port of said first RF switch being coupled to said drain direct-current blocking means, said first individual port of said first RF switch being coupled to RF reference potential;

said common port of said second RF switch being coupled to said source direct-current blocking means, said second individual port of said second RF switch being coupled to RF reference potential;

first coupling means coupling said first individual port of said third RF switch to said second port of said first RF switch;

second coupling means coupling said second individual port of said third RF switch to said first individual port of said second RF switch;

an RF output signal path coupled to said common port of said third RF switch; and control means coupled to said first, second, and third RF switches for causing said third RF switch to assume said first state in response to a request for a 180° phase condition and said second state in response to a request for a reference phase condition, and for causing said first and second RF switches to assume said first state in response to a request for a reference phase condition and said second state in response to a request for a 180° phase condition.

5. A phase bit according to claim 4, wherein each of said first and second coupling means comprises an RF attenuator.

6. A phase bit according to claim 5, wherein each of said source and drain direct-current blocking means comprises a capacitor.

7. A phase bit according to claim 4, wherein each of said direct-current biasing means coupled to said source, drain, and gate electrodes, respectively, comprises at least an impedance element, exhibiting an impedance of at least 250 ohms at operational frequencies of said phase bit, coupled to said source, drain, and gate electrodes, respectively, and to a bias voltage source.

8. A phase bit according to claim 7, wherein each of said direct-current biasing means coupled to said source, drain, and gate electrodes, respectively, further comprises a capacitor coupled said impedance element and to said reference potential.

9. A multibit phase RF phase shifter, comprising:

a phase shifter path for the flow of RF signal between first and second phase shifter ports;

a first phase bit having a phase increment of less than 180° relative to a reference value, said first phase bit comprising first and second differing lengths of transmission line, and first bit switching means coupled to said first and second lengths of transmission line for, in a first state of said first phase bit, connecting said first length of transmission line in said first path, and for, in a second state of said first phase bit, connecting said second length of transmission line in said phase shifter path;

an active second RF phase bit, comprising:

a FET including source, drain, and gate electrodes:

direct-current biasing means coupled to said source, drain, and gate electrodes, for providing biasing energization to said FET;

source, drain, and gate direct-current blocking means coupled to said source, drain, and gate, respectively, of said FET, for providing RF paths but not direct-current paths to said bias energized source, drain, and gate electrodes of said FET;

a second RF signal path coupled to said gate direct-current blocking means, whereby electromagnetic RF applied to a second phase bit RF input port is coupled to said gate electrode of said FET;

first, second, and third three-port, single-pole, double-throw RF switches, each including a common port, and first and second individual ports to which said common port is coupled in first and second states, respectively, of the RF switch;

said common port of said first RF switch being coupled to said drain direct-current blocking means, said first individual port of said first RF switch being coupled to RF reference potential;

said common port of said second RF switch being coupled to said source direct-current blocking means, said second individual port of said second RF switch being coupled to RF reference potential;

first coupling means coupling said first individual port of said third RF switch to said second port of said first RF switch;

second coupling means coupling said second individual port of said third RF switch to said first individual port of said second RF switch;

second RF phase bit control means coupled to said first, second, and third RF switches for causing said third RF switch to assume said first state in response to a request for a 180° phase condition and said second state in response to a request for a reference phase condition, and for causing said first and second RF switches to assume said first state in response to a request for a reference phase condition and said second state in response to a request for a 180° phase condition; and second RF phase bit connection means coupled to said phase shifter path, to said RF input port and to said common port of said third RF switch, for cascading said first phase bit with said second phase bit.

10. A phase shifter according to claim 9, wherein said first phase bit includes no active element other than switching element(s).

11. A phase shifter, comprising:

a solid-state device including a path for the flow of electrical current between first and second electrodes and a control electrode for controlling the flow of current through said path;

a source of signal to be phase shifted, said source of signal being coupled to said control electrode of said device, for controlling the flow of current through said path in response to said signal in such a manner that first electrode signal appearing at said first electrode in response to said signal coupled to said control electrode is in a first phase state relative thereto, and in such a manner that second electrode signal appearing at said second electrode in response to said signal coupled to said control electrode is in a second phase state, different from said first phase state;

a first switch including a common terminal coupled to said first electrode of said device and a first independent terminal coupled to reference potential, and also including a second independent terminal, for, in a first state of said first switch, coupling said first electrode of said device to said second independent terminal of said first switch to thereby define a first signal path for the flow of signal from said first electrode of said device to said second independent terminal of said first switch, and for, in a second state, coupling said first electrode of said device to said reference potential;

a second switch including a common terminal coupled to said second electrode of said device and a first independent terminal, and also including a second independent terminal coupled to reference potential, for, in a first state of said second switch, coupling said second electrode of said device to said second independent terminal of said second switch, and for, in a second state of said second switch, coupling said second electrode of said device to said first independent terminal of said second switch, thereby defining a second signal path for the flow of signal from said second electrode of said device to said second independent terminal of said second switch;

a third switch including a common terminal, and first and second independent terminals, said first independent terminal of said third switch being coupled by a fourth signal path to said first independent terminal of said second switch and said second independent terminal of said third switch being coupled by a third signal path to said second independent terminal of said first switch, said third switch connecting said common terminal of said third switch to said second independent terminal of said third switch in a first state of said third switch, and connecting said common terminal of said third switch to said first independent terminal of said third switch in said second state of said third switch;

control means coupled to said first, second, and third switches, for, in a first nominal phase condition, simultaneously controlling said first, second, and third switches to said first states of said first, second, and third switches, and for, in a second nominal phase condition, simultaneously controlling said first, second, and third switches to said second states of said first, second, and third switches; and a passive phase introducing element coupled in at least one of said first, second, third, and fourth signal paths, for modifying the phase difference occurring upon simultaneous control by said control means between said first and second nominal phase conditions to be other than 180°.

12. A phase shifter according to claim 11, wherein said first phase state of said first electrode signal appearing at said first electrode in response to said signal coupled to said control electrode is nominally 180°, and said second phase state of said second electrode signal appearing at said second electrode in response to said signal coupled to said control electrode is nominally 0°.

13. A phase shifter according to claim 11, further comprising a controllable passive RF phase bit including an RF path having a second phase increment different from said phase difference.

* * * * *